US006522117B1

(12) United States Patent
Young et al.

(10) Patent No.: US 6,522,117 B1
(45) Date of Patent: Feb. 18, 2003

(54) REFERENCE CURRENT/VOLTAGE GENERATOR HAVING REDUCED SENSITIVITY TO VARIATIONS IN POWER SUPPLY VOLTAGE AND TEMPERATURE

(75) Inventors: William R. Young, Palm Bay, FL (US); Gregg D. Croft, Palm Bay, FL (US)

(73) Assignee: Intersil Americas Inc., Irvine, CA (US)

( * ) Notice: Subject to any disclaimer, the term of this patent is extended or adjusted under 35 U.S.C. 154(b) by 0 days.

(21) Appl. No.: 09/880,726

(22) Filed: Jun. 13, 2001

(51) Int. Cl.[7] ..... G05F 3/16
(52) U.S. Cl. ..... 323/315; 323/316; 323/907
(58) Field of Search ..... 323/317, 315, 323/316, 907

(56) References Cited

U.S. PATENT DOCUMENTS 4,849,684 A * 7/1989 Sonntag et al. ..... 323/313
5,121,004 A 6/1992 Kesler et al.
5,430,395 A 7/1995 Ichimaru ..... 327/312
5,557,194 A 9/1996 Kato ..... 323/315
5,563,502 A * 10/1996 Akioka et al. ..... 323/313

OTHER PUBLICATIONS

"New Class of High–Performance PTAT Current Sources", Electronic Letters Apr. 25, 1985 vol. 21 No. 9, pp. 385–386.
Gunawan et al, "A Curvature–Corrected Low–Voltage Bandgap Reference", Jun. 6, 1993 IEEE Journal of Solid–State Circuits, vol. 28 No. 6, p. 667–670.

* cited by examiner

*Primary Examiner*—Shawn Riley
(74) *Attorney, Agent, or Firm*—Allen, Dyer, Doppelt, Milbrath & Gilchrist, P.A.

(57) ABSTRACT

A reference current/voltage gnereator is insensitive to variations in power supply voltage and temperature. The operational parameters of matched current mirror transistors of the generator are effectively equalized by an auxiliary bias amplifier, whose transistors are matched with and connected to the current mirror transistors of the generator in such a manner as to maintain the same electrical parameters in each of the current mirror legs of the current generator, irrespective of variations in supply voltage. Temperature insensitivity is achieved by making the output current mirror a current that is the sum of two currents whose current paths complementary temperature coefficients.

19 Claims, 5 Drawing Sheets

REFERENCE CURRENT/VOLTAGE GENERATOR HAVING REDUCED SENSITIVITY TO VARIATIONS IN POWER SUPPLY VOLTAGE AND TEMPERATURE

FIELD OF THE INVENTION

The present invention relates in general to circuits employed for the generation of reference currents and/or reference voltages, and is particularly directed to a new and improved multi transistor-configured reference current and voltage generator, that is effectively insensitive to variations in power supply voltage and temperature.

BACKGROUND OF THE INVENTION

FIGS. 1, 2 and 3 respectively depict conventional bipolar, CMOS and BiCMOS current mirror transistor circuits, that are widely used throughout the electronics industry to generate a reference current $I_{OUT}$, that is to be supplied to one or more signal processing circuits of an integrated circuit architecture. 'Ideally', this reference current $I_{OUT}$ may be defined by equation (1) as:

$$I_{OUT} = \frac{KT}{q} * \frac{\ln(N)}{R1} = V_T * \frac{\ln(N)}{R1} \tag{1}$$

Using the bipolar transistor configuration of FIG. 1 as a representative example of the set of three current generator circuits, the ideal value for its output reference current $I_{OUT}$ is based upon the assumption that the current mirror transistors in the two legs of the generator are perfectly matched and that each of the bipolar transistors Q1/Q2, Q4/Q5 has infinite $h_{fe}$ or beta. Namely, if current mirror transistor pair Q1 and Q2 are perfectly matched, the collector current through transistor Q1 in one leg of the circuit is equal to the collector current flowing through transistor Q2 in the opposing leg. Also, if the current mirror transistor pair Q4 and Q5 have infinite $h_{fe}$ or beta, the emitter current of transistor Q4 will be the same as the emitter current of Q5, which equals the current through resistor R1. The relationship between these currents is summarized in equation (2) as follows:

$$I_{C(Q1)}=I_{C(Q2)}=I_{C(Q4)}=I_{C(Q5)}=I_{E(Q4)}=I_{E(Q5)}=I_{R1}=I_{OUT} \tag{2}$$

In addition, the voltage drop $V_{BE(Q4)}$ across the base-emitter junction of transistor Q4 will equal the voltage drop $V_{BE(Q5)}$, plus the voltage drop across resistor R1, as set forth in equation (3) as follows:

$$V_{BE(Q4)}=V_{BE(Q5)}+I_{OUT}*R1 \tag{3}$$

It is well known that the $V_{BE}$ of a bipolar transistor is equal to the natural log (ln) of the ratio of its collector-emitter current (I) to the saturation current (Is), as set forth in equation (4).

$$V_{BE} = \frac{KT}{q} * \ln\left(\frac{I}{I_s}\right) = \frac{KT}{q} * \ln\left(\frac{I}{EmitterArea(Q5) * Js(Q5)}\right) = V_T * \ln\left(\frac{I}{EmitterArea(Q5) * Js(Q5)}\right) \tag{4}$$

The saturation current (Is) can be rewritten as the emitter area of the transistor multiplied by the saturation current per unit area, or the saturation current density (Js), as also shown in equation (4). Substituting this expression for $V_{BE}$ into equation (3) yields equation (5), as follows:

$$V_T * \ln\left(\frac{I}{EmitterArea(Q4) * Js(Q4)}\right) = V_T * \ln\left(\frac{I}{EmitterArea(Q5)Js(Q5)}\right) + I * R1 \tag{5}$$

The saturation current densities for transistors with the same doping profiles, formed in the same substrate, and using the same processing steps, will match each other extremely well. As a consequence, it may be inferred that the saturation current density of the transistor Q4 of the current generator of FIG. 1 equals the saturation current density of transistor Q5, as defined in equation (6).

$$Js(Q4)=Js(Q5)=Js(\text{npn}) \tag{6}$$

Equation (7), set forth below, shows that current mirror transistors Q4 and Q5 of the current generator of FIG. 1 are designed such that the ratio of the emitter area of transistor Q5 to the emitter area of transistor Q4 is set to a known constant N, defined in equation (7) as:

$$N=\text{EmitterArea}(Q5)/\text{EmitterArea}(Q4) \tag{7}$$

Solving equation (5) for I and substituting into equations (6) and (7) yields equation (8), as follows:

$$I = V_T * \ln\frac{\left(\frac{I * EmitterArea(Q5) * Js(Q5)}{I * EmitterArea(Q4) * Js(Q4)}\right)}{R1} = \frac{V_T * \ln(N)}{R1} \tag{8}$$

The sensitivity of a circuit to changes in its power supply voltage is called power supply rejection (PSR). If a circuit had infinite PSR, the output of that circuit would not be affected by changes in the power supply voltage. Although equation (8) implies that the reference current $I_{OUT}$ generated by the current mirror transistor circuits of the current generator architecture of FIGS. 1 through 3 is independent of its power supply voltage Vcc, this equation assumes infinite $h_{fe}$ and 'perfectly matched' current mirror transistors. In a practical circuit, however, the early voltage effect, shown in the collector current vs. collector-emitter voltage characteristic of FIG. 4, will cause mismatches in the current mirrors.

In the bipolar configuration of FIG. 1, for example, the early voltages of the two current mirror transistors Q1 and Q2 will cause a mismatch in their collector currents, since the collector-emitter voltage $V_{CE}$ of transistor Q1 is not equal to the collector-emitter voltage $V_{CE}$ of transistor Q2. This difference in collector-emitter voltages is due to the fact that the collector-emitter voltage ($V_{CE}$) of transistor Q1 equals the power supply voltage rail differential (Vcc−GND) minus the base-emitter voltage ($V_{BE}$) to GND rail differential (e.g., approximately 0.7V) of diode-connected transistor Q4.

For a Vcc=5V power supply, therefore, the $V_{CE}$ of transistor Q1 would be approximately equal to (5.0–0.7=) 4.3 volts. Since, however, its associated current mirror transistor Q2 is diode-connected, the $V_{CE}$ of transistor Q2 equals its $V_{BE}$ (0.7V), or about one-sixth of that of transistor Q1. This mismatch in the $V_{CE}$ voltages of the current mirror transistors Q1 and Q2 results in a mismatch in their collector currents (even though the $V_{BE}$ voltages of Q1 and Q2 are identical).

Such mismatches in the current mirrors will cause the reference current $I_{OUT}$ to deviate from the ideal value set forth in Equation (8). This problem is made worse by the fact that the mismatch in the current mirror transistors will change as the power supply voltage varies. Therefore, due to the early voltage effect alone, the reference current $I_{OUT}$ generated by the circuits shown in FIGS. 1 through 3 is not independent of power supply voltage variation.

This can be a significant problem in low voltage applications having reduced power supply 'headroom', where high power supply rejection is required. Such headroom limitations are becoming increasingly common as the industry continues to use lower and lower power supply voltages. To solve this problem in a bipolar circuit of the type shown in FIG. 1, it has been proposed to couple an auxiliary bias amplifier in circuit with one of the legs of the current generator, as diagrammatically illustrated in FIG. 5, and as described, for example, in an article by M. Gunawan et al, entitled: "A Curvature-Corrected Low Voltage Bandgap Reference", IEEE Journal of Solid-State Circuits, Vol. 28, No. 6, June 1993, pp 667–670, and also in an article by H. Nauta et al, entitled: "New Class of High-Performance PTAT Current Sources," Electronics Letters, Apr. 25, 1985, Vol. No. 9, pp 384–386.

In the bipolar scheme of FIG. 5, the voltages across associated transistors of the two current mirror legs of the current generator are effectively equalized by means of an auxiliary bias amplifier 50, formed of a current mirror PNP transistor Q51 and a $V_{CE}$-controlling NPN transistor Q55. These two bias amplifier transistors have their collector-emitter current paths connected in parallel with those of transistor pairs Q52/Q53 and Q56/Q57, of the two current mirror legs that are connected between the power supply rails (Vcc and ground).

The first polarity (PNP) transistor Q51 of the auxiliary bias amplifier 50 is connected in a diode configuration (having its collector connected to its base), with the base electrode of PNP transistor Q51 being connected in common to the bases of PNP transistors Q52 and Q53, and Q54 with which auxiliary transistor Q51 forms a current mirror. The base of the second polarity (NPN) transistor Q55 of the auxiliary bias amplifier is coupled to the collector current path of that leg of the current generator containing PNP current mirror transistor Q52 and NPN current mirror transistor Q56. The PNP transistor Q51 of the bias amplifier 50 is matched with PNP current mirror transistors Q52 and Q53, and Q54, and NPN transistor Q55 is matched with NPN current mirror transistor Q56 and scaled with NPN transistor Q57.

The bias amplifier transistors Q51 and Q55 operate at the same current level as the current mirror transistors of the two legs of the current generator, and the bias amplifier 50 biases the PNP current mirror transistor pair Q52 and Q53 to produce currents that are equal to the current in the bias amplifier's PNP transistor Q51, by means of current mirror action with PNP transistor Q52.

Adding the bias amplifier circuit results in a positive feedback circuit containing transistors Q55–Q51 for the base drive to the current mirror transistors Q52 and Q53, and serving to clamp the collector voltages of current mirror transistors Q56 and Q57 at the same base-emitter voltage ($V_{BE55}$=$V_{BE56}$) of transistors Q55 and Q56, respectively. In addition, a negative feedback circuit is formed by transistor Q57 and resistor R51. For stability, the gain of the negative feedback circuit may be made greater than that of the positive feedback circuit, by connecting a capacitor across the base and collector of transistor Q55, so as to provide a rapid roll-off in the gain of the positive feedback circuit at high frequencies.

In operation, with the base of the $V_{CE}$-controlling NPN transistor Q55 connected to the collector of NPN transistor Q56, any current differences between transistors Q55 and Q56 are due to base currents required by the PNP transistors Q51 through Q54, and differences in the collector-emitter voltages $V_{CE}$ of the two NPN transistors Q55 and Q56. If the first set of matched PNP transistors Q51–Q54 have reasonably high betas, their base currents will cause only a small percentage of error. Also, the early voltage effects described above with reference to FIG. 4 will cause only small differences in their collector currents.

The NPN transistor Q55 clamps the collector voltage of NPN transistor Q56 in the leg containing transistor Q52 at one base-emitter voltage ($V_{BE55}$) above the supply rail (GND) to which its emitter is connected. With transistors Q55 and Q56 being matched, and with the base of the NPN transistor Q56 connected to the collector of the NPN transistor Q57 in the leg containing transistor Q53, then the NPN transistor Q56 similarly clamps the collector voltage of NPN transistor Q57 at one base-emitter voltage ($V_{BE56}$) above the supply rail (GND) to which its emitter is connected. Therefore, the $V_{CE}$ of the current mirror transistor Q56 will be very close to that of current mirror transistor Q53. As a result, the current through the leg containing PNP transistor Q52 and NPN transistor Q56 will effectively match the current through the leg containing PNP transistor Q53 (which is mirrored with transistor Q52) and NPN transistor Q57 (which is ratioed with transistor Q56). This means that the current $I_{OUT}$ generated at the collector of the output transistor Q54 will be effectively insensitive to variations in the power supply rail voltages.

SUMMARY OF THE INVENTION

In accordance with the present invention, the ability of the auxiliary bias amplifier-incorporating current generator circuit architecture of FIG. 5 to reduce its sensitivity to variations in power supply voltage is augmented by means of temperature compensation circuitry that is effective to make the current generator insensitive to variations in temperature. As will be described, temperature insensitivity is achieved by generating a current that is the sum or composite of two currents having complementary temperature coefficients.

One current has a positive temperature coefficient, being proportional to KT/q (where K is Boltzman's constant, T is temperature °K. and q is charge), divided by the value of a first resistor connected between the emitter of a second polarity current mirror transistor and a power supply rail. The second current (which has a negative temperature coefficient) flows through a second resistor and is proportional to the $V_{BE}$ of a second polarity current mirror transistor divided by the resistance of a second resistor, connected across the base-emitter junction of the second polarity current mirror transistor.

Since this second current has a negative temperature coefficient, the sum of the two currents at the collector of a current mirror transistor can be set to have a positive, negative, or near zero temperature coefficient, based upon the ratioing of the two currents. The generated output current can be made relatively insensitive to both supply voltage variations and temperature changes, as long as a proper resistor ratio is employed.

To minimize any effect of temperature change, the resistors are preferably made of a material having as low a temperature coefficient as possible. The ability of the augmented generator circuit of the invention to provide an output current that is insensitive to variations in power supply voltage and temperature means that the output current may also be used to generate a stable reference voltage, such as that provided by a bandgap voltage generator.

In accordance with a further aspect of the invention, there is provided a new and improved CMOS current generator architecture, which incorporates an auxiliary CMOS amplifier that is configured and biased to reduce its sensitivity to variations in power supply voltage. Like a augmented bipolar current generator, the CMOS current generator may be augmented by temperature compensation circuitry, so as to provide an output current that is insensitive to both variations in power supply voltage and temperature. As such, the CMOS configured circuit of the invention may also be used to generate a stable reference voltage.

DETAILED DESCRIPTION

Figure 1:
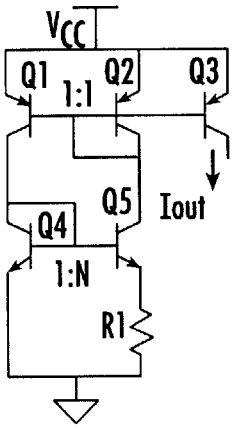
FIG. 1. (PRIOR ART)
FIGS. 1, 2 and 3 respectively depict conventional bipolar, CMOS and BiCMOS current mirror transistor circuits for generating a reference output current.
Figure 2:
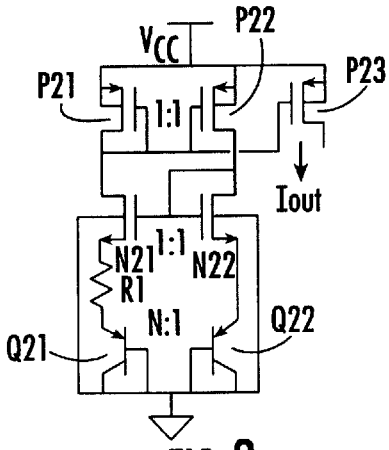
FIG. 2. (PRIOR ART)
Figure 3:
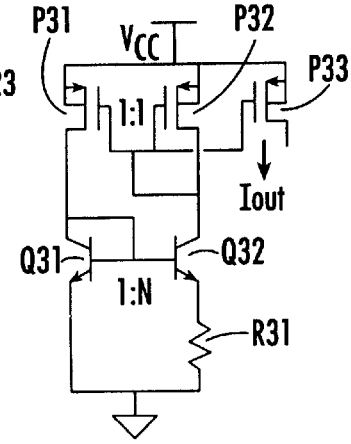
FIG. 3. (PRIOR ART)
Figure 4:
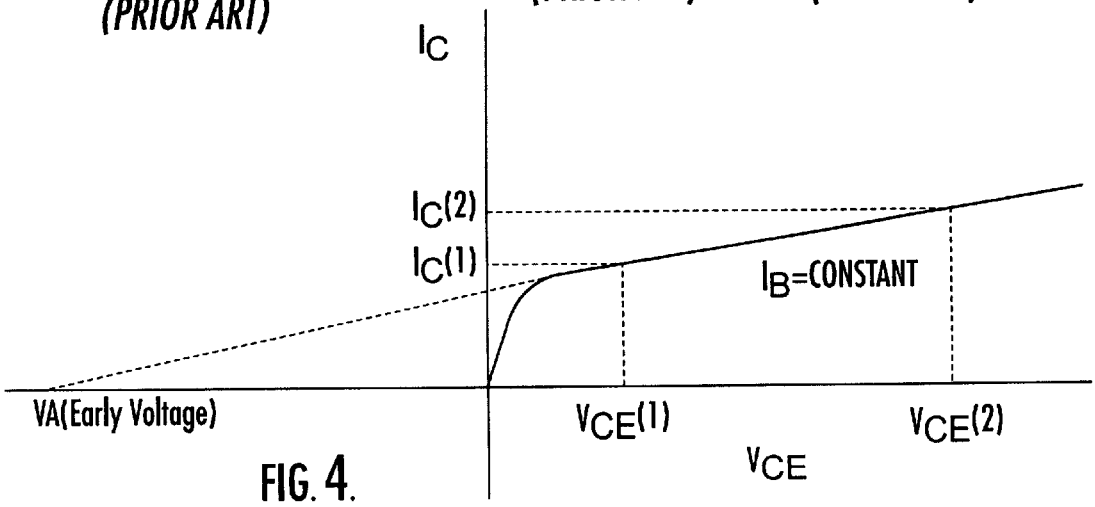
FIG. 4 shows the early voltage effect in the collector current vs. collector-emitter voltage characteristic of a typical bipolar transistor.
Figure 5:
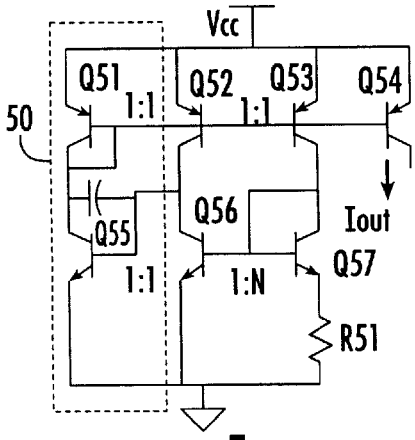
FIG. 5. (PRIOR ART)
FIG. 5 is a circuit diagram of a prior art power supply insensitive bipolar current mirror transistor circuit for generating a reference output current.
Figure 6:
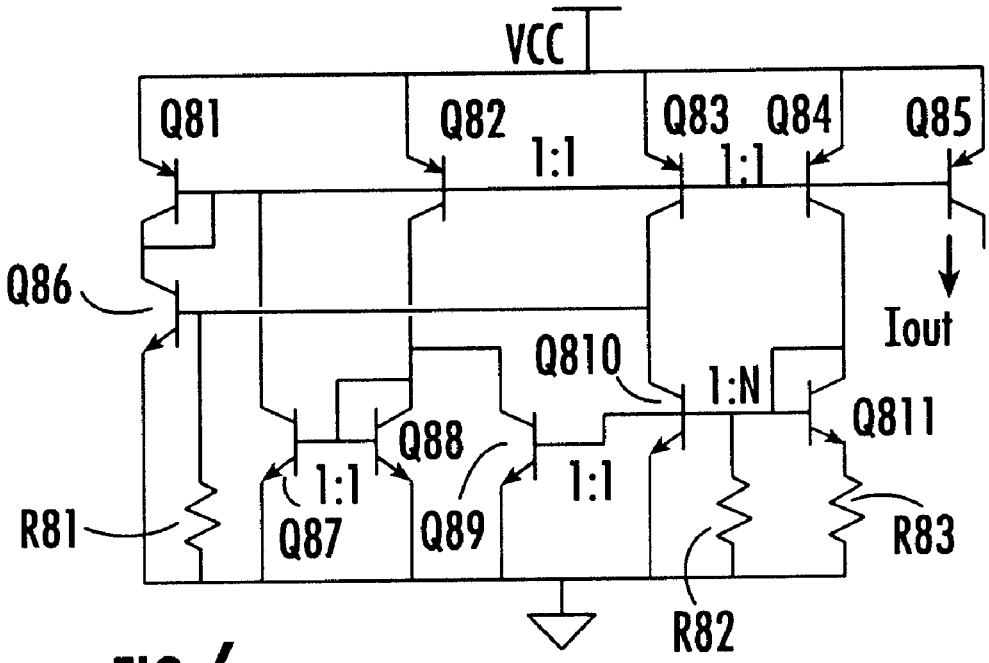
FIG. 6 shows a bipolar current generator circuit architecture in accordance with the present invention, incorporating temperature compensation circuitry that makes the output current effectively insensitive to changes in supply voltage and temperature.

FIG. 6 shows a modification of the bipolar current generator circuit architecture of FIG. 5 in accordance with the present invention, to incorporate temperature compensation circuitry that is effective to make its output current $I_{OUT}$ insensitive to changes in both supply voltage and temperature. In the augmented current generator of FIG. 6, power supply voltage insensitivity is accomplished in the same manner as the bipolar current generator of FIG. 5. Temperature insensitivity is realized by generating a composite current that is the sum or composite of two currents having complementary temperature coefficients, such that the resultant current is substantially invariant with temperature.

In the circuit of FIG. 6, the first of these two complementary currents is a collector current $I_{CQ811}$ of transistor Q811, which has a positive temperature coefficient, increasing as temperature increases. This current is proportional to KT/q (where K is Boltzman's constant, T is temperature (k°) and q is charge), divided by the value of a resistor R83 connected between the emitter of NPN transistor Q811 and the ground supply rail. The second current $I_{R82}$ (which has a negative temperature coefficient) flows through a resistor R82 and is proportional to the $V_{BE}$ of an NPN transistor Q810, divided by the resistance of the resistor R82, which is connected across the base-emitter junction of transistor Q810. Since the current $I_{R82}$ through resistor R82 decreases with increase in temperature, then, depending upon the ratio of the first and second currents, the composite of these currents corresponding to their sum at the collector of current mirror transistor Q84 can be set to have a positive, negative, or near zero (flat) temperature coefficient.

In the temperature-compensated reference current generator embodiment of FIG. 6, PNP transistors Q83 and Q84 form a primary current mirror. If NPN transistors Q810 and Q811 have reasonably high betas, then their base currents are very small compared to their collector currents, so that essentially all of the collector current through the current mirror transistor Q84 flows into a circuit having a first leg through the collector-emitter path of the transistor Q811 and the resistor R83 and a second leg through resistor R82. In a similar manner, essentially all of the collector current of current mirror transistor Q83 will flow into a circuit having a first leg through the collector-emitter path of transistor Q810 and a second leg through a resistor R81.

Similar to the coupling of resistor 82 across the base-emitter junction of transistor Q810, resistor 81 is coupled across the base-emitter junction of an NPN transistor Q86 (which is matched with transistor Q810. The collector current path of NPN transistor Q86 is coupled to a PNP transistor Q81, that is connected in current mirror configuration with matched current mirror transistors Q82, Q83, Q84 and Q85. Similar to a current-diverting or 'siphoning' effect of resistor 82 relative to the collector current of current mirror transistor Q84, the resistor 81 serves to 'siphon off' part of the collector current of the current mirror transistor Q83.

Therefore, if the resistors R81 and R82 are matched components, and if the voltages across these resistors are also matched, then the currents through resistors R81 and R82 will be the same. This means that the collector currents of the transistors Q810 and Q811 must match.

As shown in the circuit diagram of FIG. 6, the geometry (emitter area) of transistor Q811 is N times that of the transistor Q810. By making the ratio N only slightly greater than 1.0 (e.g., 1.01), a number of benefits can be achieved. For purposes of illustration, transistor Q810 may be formed of a relatively large first number of identical transistors (e.g., 100 transistors) connected in parallel with each other, and transistor Q811 may comprise a similarly large second number of identical transistors (e.g., 101 transistors) connected in parallel with each other (so as to result in a geometry ratio that is relatively close to 1, here N:1= 101:100).

In such a circuit configuration, although each of transistors Q810 and Q811 is formed of a large number of devices in order to obtain a substantial overall emitter area, the geometry difference between the two devices is relatively small. This serves to provide a number of useful effects. First, it effectively integrates out the dispersion of a typical random distribution of defects formed in the two devices during the manufacturing process. Secondly, it serves to balance out their inherent base resistances. Thirdly, and of particular benefit, is the fact that it enables a very small current to be realized by a relatively small valued emitter resistor R83, thereby improving integration density, and reducing IR losses.

The collector currents of the transistors Q810 and Q811 may be defined in equation (9) as:

$$I_{Q810}=I_{Q811}=V_T*\ln(N)/R83 \quad (9)$$

As described above, the voltage across the resistor R82 is established by the $V_{BE}$ of transistor Q810, so that the current $I_{R82}$ through resistor R82 may be defined in equation (10) as:

$$I_{R82}=V_{BE(Q810)}/R82 \quad (10)$$

The collector-emitter current ICE(Q84) of transistor Q84 equals the collector current of transistor Q811 plus the current through the resistor R82. Namely, as shown in equation (11):

$$I_{CE(Q84)}=V_T*\ln(N)/R83+V_{BE(Q810)}/R82 \quad (11)$$

By properly setting the ratio of the resistor R83 to the resistor R82, the current $I_{CE(Q84)}$ may be made to have a near zero or substantially 'flat' temperature coefficient.

This collector-emitter current $I_{CE(Q84)}$ of PNP transistor Q84 is mirrored in the matched PNP transistors Q81, Q82, Q83 and Q85, as shown in equation (12) as:

$$I_{CE(Q84)}=I_{Q81}=I_{Q82}=I_{Q83}=V_T*\text{In}\ (N)/R83+V_{BEQ810}/R82=I_{Q85} \quad (12)$$

An NPN transistor Q89 is connected in current mirror configuration with NPN transistor Q810, with its collector connected to the collector of current mirror transistor Q82 and to the collector and base of diode-connected NPN transistor Q88. The geometry of NPN transistor Q89 is matched to that of transistor Q810, so that the current $I_{Q89}$ flowing through transistor Q89 is the same as that flowing through transistor Q810 and may be defined in equation (13) as:

$$I_{Q89}=I_{Q810}=V_T*\ln(N)/R83 \quad (13)$$

Subtracting the current $I_{Q89}$ from the current $I_{Q82}$ causes the current to flowing through the diode-connected NPN transistor Q88 (the collector-emitter path of which is coupled in parallel with NPN transistor Q89) to be proportional to the $V_{BE}$ of NPN transistor Q810, as set forth in equation (14).

$$I_{Q88}=I_{Q82-IQ89}=V_T*\ln\ (N)/R83+V_{BE(Q810)}/R82-V_T*\ln(N)/R83 \quad (14)$$

The current $I_{Q88}$ is mirrored by an NPN transistor Q87, the base of which is coupled to the base of NPN transistor Q88 and the collector-emitter path of which is coupled in parallel with that of an NPN transistor Q86 to the collector of current mirror transistor Q81. As can be seen from this circuit connection, and as is shown in equations (15) and (16), the current $I_{Q87}$ mirrored in NPN transistor Q87 is therefore subtracted from the current of the PNP transistor Q81, resulting in the current flowing through the transistor Q86 being proportional to $V_T$. Namely:

$$I_{Q87}=I_{Q88}=V_{BE(Q810)}/R82 \quad (15)$$

$$I_{Q86}=I_{Q81}=I_{Q87}=V_T*\ln\ (N)/R83+V_{BE(Q810)/R}82=V_T*\ln(N)/R83 \quad (16)$$

It can be seen therefore, that the circuit containing transistors Q82, Q87 and Q89 serves as a second order refinement to the first order balancing effect of transistors Q81 and Q86 to transistor Q810. As a consequence, since the NPN transistors Q86 and Q810 are matched transistors, and they both have approximately the same currents flowing through them, their base-emitter voltages $V_{BE86}$ and $V_{BE810}$ will be nearly identical. These $V_{BE}$ voltages are applied across the resistor R81, which is coupled across the base-emitter junction of NPN transistor Q86, and resistor R82, which is coupled across the base-emitter junction of NPN transistor Q810, and generate the nearly equal currents referenced above.

It will be appreciated therefore that the generated current $I_{OUT}$ will be relatively insensitive to both supply voltage variations and temperature variations, as long as the correct ratio of resistor R83 to the matched resistor pair R81 and R82 is used. Preferably, resistors R81, R82 and R83 are made of a material having as low a temperature coefficient as possible, to minimize temperature variations. The circuit architecture of FIG. 6 can function with a power supply voltage as low as $2*V_{BE}$. Therefore, a 2V power supply can be employed even at very low temperatures.

Figure 7:
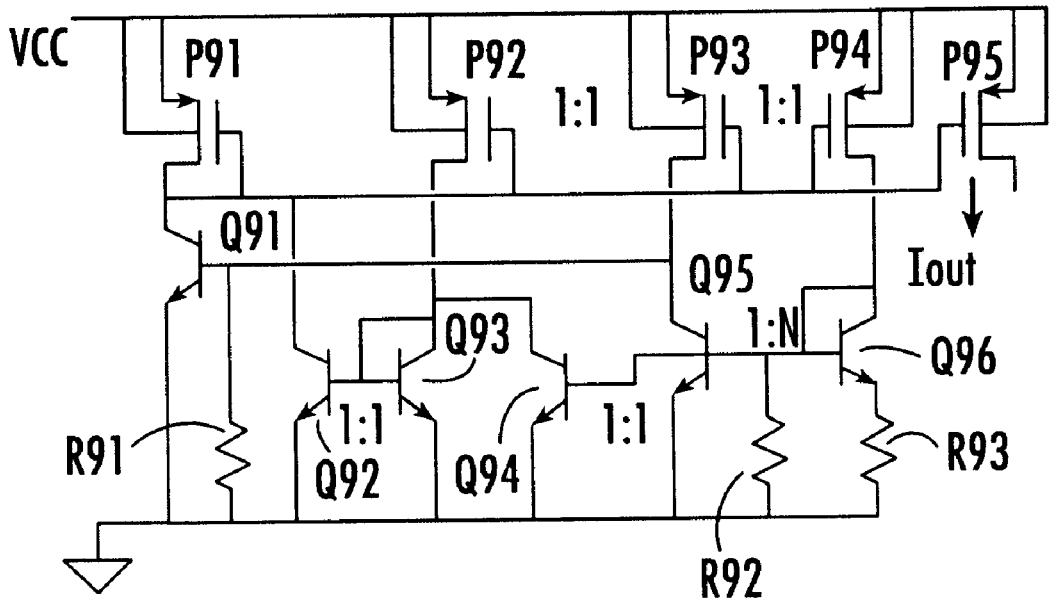
FIG. 7 shows a reduced voltage BiCMOS architecture version of the temperature compensated current generator circuit of FIG. 6.

A reduced voltage version of the generator circuit of FIG. 6 may be implemented using a BiCMOS architecture as shown in FIG. 7. The generator circuit of FIG. 7 functions in the same way as the circuit in FIG. 6, except that the PNP bipolar transistors Q81–Q85 of FIG. 6 have been replaced by PMOS devices P91–P95. These PMOS devices will continue to operate in their saturated regions, as long as $V_{DS}>(V_{GS-VT})$. Therefore, these devices can operate at very low $V_{DS}$ voltages. Indeed, the BiCMOS circuit shown in FIG. 7 can operate with a power supply voltage lower than one volt.

A shortcoming of the circuit of FIG. 6 is the current mirror formed by transistors Q87 and Q88. The collector-emitter voltage $V_{CE}$ of transistor Q88 is equal to the base-emitter voltage $V_{BE}$ of current mirror transistor Q88, while the collector-emitter voltage $V_{CE}$ of transistor Q87 is equal to the supply rail voltage Vcc minus the base-emitter voltage $V_{BE}$ of transistor Q81. Early voltage effects will cause a current mismatch between transistors Q88 and Q87, which has a small effect on the PSR of the output current $I_{OUT}$.

Figure 8:
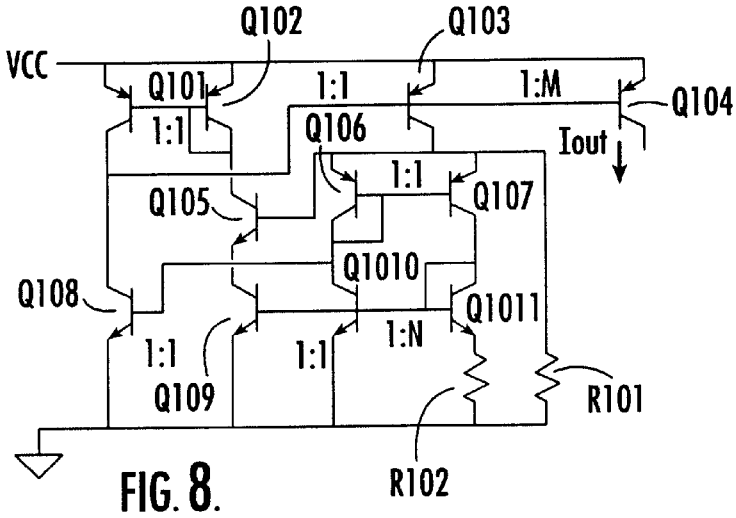
FIG. 8 shows a bipolar-configured temperature and power supply rejection-compensated current generator circuit architecture for reducing early voltage effects.

A current generator circuit architecture for reducing this problem is shown in FIG. 8. That portion of the circuit of FIG. 8 that generates a current proportional to $V_T$ consists of a current mirror circuit comprised of PNP current mirror transistors Q106, Q107, and NPN ratioed transistors Q1010, Q1011, and a resistor R102, which is coupled in the collector-emitter current path of transistor Q1011. PNP current mirror transistors Q106 and Q107 have matched emitter areas. Ratioed NPN transistor Q1011 has N times the emitter area of NPN transistor Q1010. With the currents through transistors Q1010 and Q1011 matched, due to the current source formed by PNP transistors Q106 and Q107.

The respective collector currents $I_{Q106}$ and $I_{Q107}$ of PNP transistors Q106 and Q107 are the same and may be defined in equation (17) as:

$$I_{Q106}=I_{Q107}=VT*\ln(N)/R_{102} \quad (17)$$

The collector current $I_{Q103}$ through PNP transistor Q103 is defined in equation (18) as:

$$I_{Q103}=I_{Q106}+I_{Q107}+I_{R101}-2^{*}\ V_T{}^{*}\ln(N)/R\mathbf{102}+I_{R101} \quad (18)$$

The current through the resistor R101 is defined by the sum of the $V_{BE}$ of transistor Q108 and the base-emitter voltage $V_{BE}$ of transistor Q107, defined in equation (19) as:

$$_{,}R101=2V_{BE}/R\mathbf{101} \quad (19)$$

The current $I_{Q103}$ through transistor Q103 is the sum of a current proportional to VT and a current proportional to $V_{BE}$, defined in equation (20) as:

$$I_{Q103}=2^{*}V_T{}^{*}\ln(N)/R_{102}+2V_{BE}/R\mathbf{101} \quad (20)$$

By the proper choice of resistor ratio of R101 to R102, the temperature coefficient of this current $I_{Q103}$ can be set close to zero. The power supply rejection of the current proportional to $V_T$ depends on how well the collector-emitter voltages $V_{CE}$ of transistors Q106 and Q107 match one another, as the power supply voltage is varied.

Since the emitters of transistors Q106 and Q107 are connected together, the collector-emitter voltage V*CE* match of transistors Q106 and Q107 depends on their collector voltages. The collector voltage of transistor Q107 is set by the base-emitter voltage $V_{BE}$ of transistor Q1010. The current through transistor Q1010 is mirrored by transistor Q109. Transistor Q105 has its collector-emitter current path coupled in cascode with transistor Q109 to keep the collector-emitter $V_{CE}$ voltages of transistors Q1010 and Q109 close to each other.

As shown in equation (21), the $V_{CE(Q1010)}$ of transistor NPN Q1010 equals the $V_{BE(Q108)}$ of NPN transistor Q108 as:

$$V_{CE(Q10101)}=V_{BE(Q108)} \quad (21)$$

The $V_{CE(Q109)}$ of transistor Q109 equals the sum of the base-emitter voltage $V_{BE(Q108)}$ of transistor Q108, plus the base-emitter voltage $V_{BE(Q107)}$ of transistor Q107 minus the base-emitter voltage $V_{BE(105)}$ of transistor Q105, as set forth in equation (22).

$$V_{CE(Q10101)}=V_{BE(Q108)}+V_{BE(Q107)}-V_{BE(Q105)} \quad (22)$$

Since the base-emitter voltage $V_{BE}$ of an NPN transistor and that of a PNP transistor are substantially equal to each other, the collector-emitter voltages of transistors Q109 and Q1010 are substantially the same. In the current mirror formed by PNP transistors Q101 and Q102, the $V_{CEQ102}$ of diode-connected transistor Q102 is equal to the $V_{BEQ102}$ of Q102, and the $V_{CEQ101}$ of transistor Q101 is equal to the $V_{BEQ103}$ of transistor Q103.

These two $V_{BE}$ voltages will remain approximately equal to each other as the power supply voltage is varied. Therefore, the emitter current of transistor Q108 will approximately match the emitter current of transistor Q1010. If the emitter areas of transistors Q108 and Q1010 are matched, their $V_{BE}$ voltages will match.

Matching or equating the respective collector voltages $V_{C(Q106)}$ and $V_{C(Q107)}$ of transistors Q106 and Q107 improves the PSR of the current that is proportional to $V_T$. These voltages are defined individually in equations (23) and (24) as:

$$V_{C(Q106)}=V_{BE(Q108)} \quad (23)$$

$$V_{C(Q107)}=V_{BE(Q1010)} \quad (24)$$

The current $I_{R103}$ through resistor R101 equals the sum of the $V_{BEQ107}$ of transistor Q107 plus the $V_{BEQ108}$ of transistor Q108 divided by the resistance of resistor R101. Both of these $V_{BE}$ voltages are relatively insensitive to power supply variations, because they are determined by currents proportional to $V_T$. Therefore, the current through resistor R101 will also be relatively insensitive to supply voltage variations. The currents proportional to $V_T$ and $V_{BE}$ are provided by transistor Q103 and are mirrored as $I_{OUT}$ by transistor Q104. With the proper ratio of resistors R101 to R102, the generated output current $I_{OUT}$ will have a high PSR and a low temperature variation.

As pointed out briefly above, because the dual compensated current generator circuit of the invention is operative to provide an output current that is effectively insensitive to variations in both power supply voltage and temperature, this output current may be used to generate a stable reference voltage, such as that provided by a bandgap voltage generator.

Figure 9:
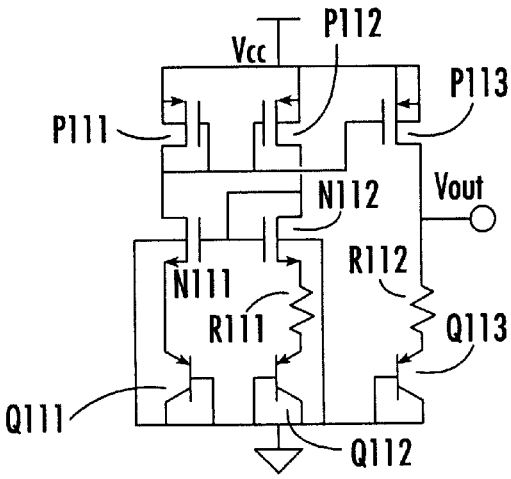
FIG. 9. (PRIOR ART)
FIG. 9 shows an example of a conventional bandgap reference voltage generator implemented using an N-well CMOS architecture.

An example of a conventional bandgap reference voltage generator implemented using an N-well CMOS architecture is diagrammatically illustrated in FIG. 9. The conventional circuit of FIG. 9 effectively corresponds to the circuit diagram shown on page 597 of the text by P. Allen et al, entitled: "CMOS Analog Circuit Design,", published by Harcourt Brace Jovanovich College Publishers, 1987. The bandgap reference voltage circuit of FIG. 9 generates a (bandgap) reference voltage $V_{OUT}$, that is ideally equal to:

$$V_{OUT}=V_{BE(Q113)}+R\mathbf{112}^{*}V_T{}^{*}\ln(N)/R\mathbf{111} \quad (25)$$

For the proper ratio of resistors R111 and R112, $V_{OUT}$ will be relatively constant over a reasonably large temperature range. However, variations in the power supply voltage will have a noticeable affect on $V_{OUT}$ due to the channel length modulation of MOSFETs P111 and P112.

Figure 10:
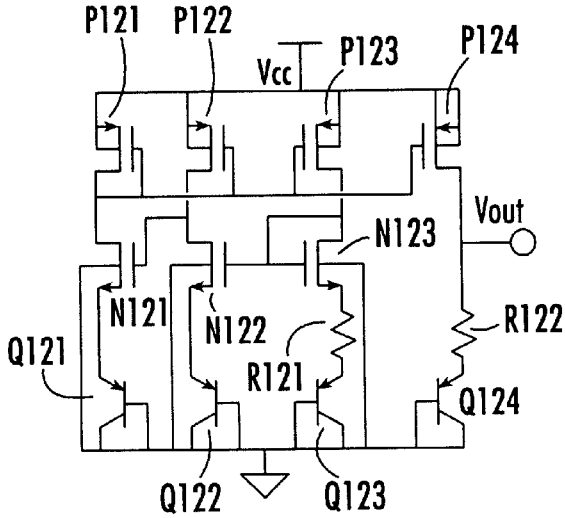
FIG. 10 is a circuit diagram of a power supply insensitive CMOS current mirror transistor circuit for generating a reference output current in accordance with a further aspect of the present invention.
Figure 11:
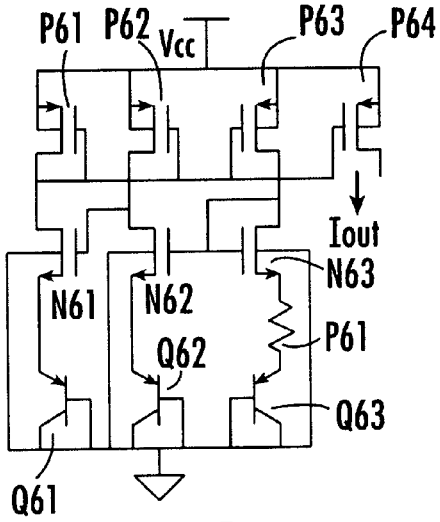
FIG. 11 shows a modification of the CMOS-implemented bandgap reference voltage generator of FIG. 9 that incorporates the CMOS bias amplifier circuitry of FIG. 10.
Figure 16:
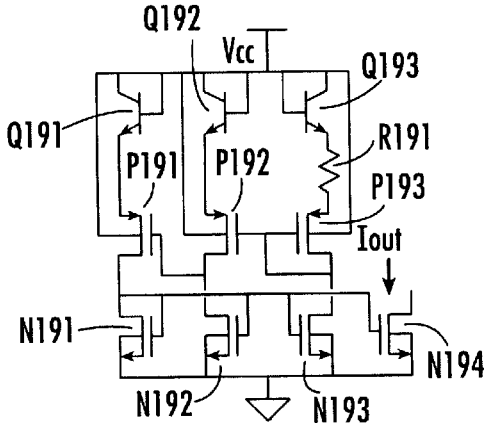
FIG. 16 shows a complementary current flow polarity equivalent of the CMOS current generator of FIG. 11.

FIG. 10 shows a modification of the circuit of FIG. 9, that incorporates CMOS-configured bias amplifier circuitry in accordance with a further aspect of the present invention, shown in FIG. 11, so that the power supply rejection of the voltage generator of FIG. 10 can be increased without any additional operating headroom. A NWELL process equivalent of the PWELL process CMOS circuit of FIG. 11 is shown in FIG. 16. In order to avoid unnecessarily encumbering the present description with details that are readily apparent to one skilled in the art, the architecture of FIG. 11 will be explained. From this explanation, application of the CMOS circuit of FIG. 11 to realize the complementary circuit embodiment of FIG. 16 is straightforward.

In the CMOS-configured power supply variation compensated current generator of FIG. 11, the voltages across associated MOSFETs of the two current mirror legs containing CMOS MOSFET pairs P62-N62 and P63-N63, and associated bipolar transistors Q62 and Q63 and resistor R63 are effectively equalized by means of an auxiliary CMOS bias amplifier formed of a current mirror N channel MOSFET N61, P channel MOSFET P61 and PNP transistor Q61. The bias amplifier MOSFETs have their source-drain current paths connected in parallel with those of CMOS pairs of the two current mirror legs that are connected between the power supply rails (Vcc and ground).

P channel MOSFET P61 of the auxiliary CMOS bias amplifier is connected in a diode configuration, having its drain connected to its gate, with the gate of P channel MOSFET P61 connected in common to the gates of P channel MOSFETs P62, P63 and P64, with which auxiliary amplifier P-channel MOSFET P61 forms a current mirror. The gate of the N channel MOSFET N61 of the auxiliary CMOS bias amplifier is coupled to the drain current path of that leg of the current generator containing P channel current mirror MOSFET P62 and N channel current mirror MOSFET N62. The P channel MOSFET P61 of the CMOS bias amplifier is matched with P channel current mirror MOSFETs P62, P63 and P64, and N channel MOSFET N61 is matched with N channel current mirror MOSFETs N62 and N63.

The bias amplifier MOSFETs P61 and N61 operate at the same current level as the current mirror MOSFETs of the two legs of the current generator, and the bias amplifier biases the P channel current mirror MOSFET pair P62 and P63 to produce currents that are equal to the current in the bias amplifier's P channel MOSFET P61, by means of current mirror action with P channel MOSFET P62. Adding the bias amplifier circuit results in a positive feedback circuit containing MOSFETs P61-N61 for the gate drive to the current mirror P channel MOSFETs P62 and P63, and serving to clamp the drain voltage of current mirror N channel MOSFETs N62 at approximately the same drain voltage as N channel MOSFETs N63. In addition, a negative feedback circuit is formed by N channel MOSFET N63 and resistor R63.

In operation, since the gate of N channel MOSFET N61 is connected to the drain N channel MOSFET N62, current differences between N channel MOSFETs N61 and N62 are the result of the gate-source voltages for the P channel MOSFETS P61–P64, and differences in the drain-source voltages $V_{DS}$ of N channel MOSFETs N61 and N62. The bias amplifier's N channel MOSFET N61 clamps the drain voltage of N channel MOSFET N62 at the gate-source voltage $V_{GSN61}$, plus the base-emitter voltage $V_{BEQ61}$ of NPN transistor Q61 above the supply rail to which its base and collector are connected.

Since N channel MOSFETS N61 and N62 are matched, NPN transistors Q61 and Q62 are matched, MOSFETs N61 and N62 are operating at the same current, the gate of the N channel MOSFET N61 clamps the drain voltage of N channel MOSFET N62 at the gate voltage $V_{GN62}$, which equals the drain voltage of N channel MOSFET N63. N channel MOSFET N63 is matched to N channel MOSFETs N61 and N62, and bipolar transistor Q63 is N times the emitter area of transistors Q61 and Q62. The output current $I_{OUT}$ will therefore be given by equation (26) as follows:

$$I_{OUT}=V_T*\ln(N)/R63 \tag{26}$$

As a result, the current I*OUT* generated at the drain of the output P channel MOSFET P64 is effectively insensitive to variations in the power supply voltages.

In the voltage generator of FIG. 10, the CMOS current generator circuit of FIG. 11 is modified to incorporate a bipolar transistor Q124 and a resistor R122—enabling the temperature variations of the output current of FIG. 10 to be compensated to generate a stable output voltage V*OUT* without any additional operating headroom.

In particular, the $V_{BEQ124}$ of bipolar transistor Q124 provides a voltage proportional to $V_{BE}$. The current from transistor P124 and resistor R122 provide a voltage proportional to $V_T$. If the resistors R121 and R122 are properly selected, the output voltage will be temperature-compensated, as shown in the following equation (27):

$$V_{OUT}=V_{BEQ}+R122*V_T*\ln(N)/R121 \tag{27}$$

Figure 12:
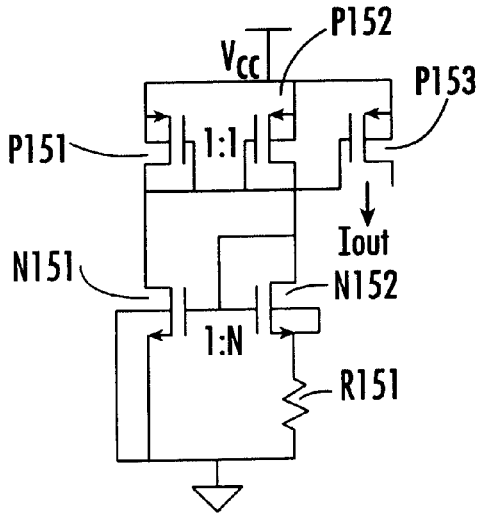
FIG. 12. (PRIOR ART)
FIG. 12 shows a further conventional CMOS reference current generator.

FIG. 12 shows a further conventional CMOS reference current generator, in which matched P channel MOSFETs P151 and P152 are connected in a current mirror configuration and N channel MOSFETs N151 and N152 have matched gate lengths $L_{P151}$ and $L_{P152}$, but different gate widths $W_{P151}$ and $W_{P152}$.

$$\text{Namely, } L_{P151}=L_{P152} \tag{28}$$

$$W_{P151}=W_{P152}, \text{ and} \tag{29}$$

$$L_{P151}=L_{N152}=L \tag{30}$$

Where the gate width $W_{N152}$ of N channel MOSFET N152 that is N times the gate width $W_{N151}$ of N channel MOSFET N151. Namely, $$N*W_{N152}=W_{N152} \tag{31}$$

Solving equation (31) for the ratio of $W_{N152}$ to $W_{W151}$ produces equation (32) as:

$$N=W_{N152}/W_{W151} \tag{32}$$

If the current mirror formed by P channel MOSFETs P151 and P152 is perfectly matched, then the drain-source current $I_{DSP151}$ of P channel MOSFET P151 is equal to the $I_{DSP152}$ of P channel MOSFET P152. In addition, the $I_{DSP151}$ of P channel MOSFET P151 must equal the $I_{DSN151}$ of N channel MOSFET N151, since MOSFETs P151 and N151 are connected in series. Likewise, the $I_{DSP152}$ of P channel MOSFET P152 must equal the $I_{DSN112}$ of N channel MOSFET N152, which must also equal the current $I_{R151}$ through resistor R151, which is summarized in equation (38). For simplicity this current is referred to as I.

$$I_{DSP151}=I_{DSP152}=I_{DSN151}=I_{DSN152}=I_{R151}=I \tag{33}$$

Where N channel MOSFET N161 is operating in the saturated region, the current I can be calculated using equation (31) as follows:

$$I = K_{PN} * \frac{W}{L} * (V_G - V_{TN})^2 \quad \text{where:} \quad K_{PN} = \frac{\mu_N * C_{OX}}{2} \tag{34}$$

Solving equation (34) for $V_G-V_{TN}$ yields equation (35) as:

$$V_G - V_{TN} = \sqrt{\frac{I * L}{K_{PN} * W_{N151}}} \tag{35}$$

Equation (34) can also be applied to N channel MOSFET N152, yielding equation (36) as follows:

$$I = K_{PN} * \frac{W_{N152}}{L} * (V_G - V_{TN} - I * R151)^2 \tag{36}$$

The expression of $V_G-V_T$ in equation (35) can be substituted in equation (36), yielding equation (37) as follows:

$$I = K_{PN} * \frac{W_{N2}}{L} * \left(\sqrt{\frac{I * L}{K_{PN} * W_{N151}}} - (I * R151)\right)^2 \tag{37}$$

Solving equation (37) for I and substituting into equation (36) yields equation (38) as:

$$I = \frac{L}{W_{N151} * K_{PN} * R151^2} * \left(1 - \frac{1}{\sqrt{N}}\right)^2 \tag{38}$$

Equation (38) indicates that the current I is set by $K_{PN}$, the MOSFET widths W, the MOSFET lengths L, and the value of resistor R151. Ideally, this current is independent of the supply voltage. However, mismatches in the drain-source voltages of P channel MOSFETs P151 and P152 can cause mismatches in the currents generated by the current mirror. The mismatch in the drain-source voltages of P channel MOSFETs P151 and P152 will vary as the supply voltage is varied. Therefore, the output current will also exhibit variation with supply voltage.

Figure 13:
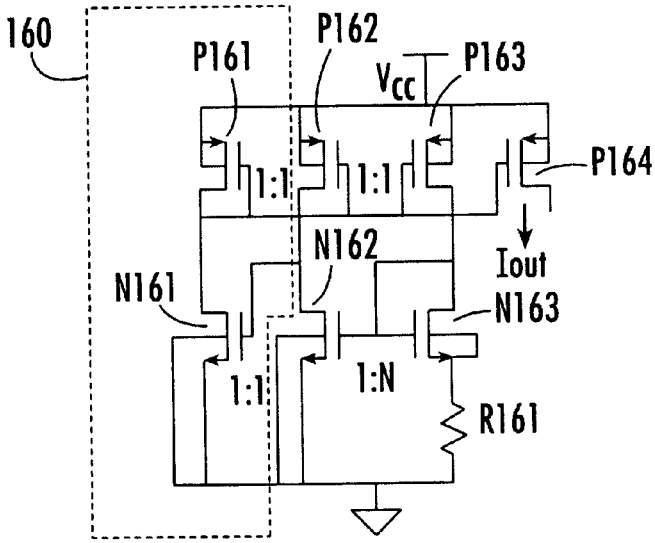
FIG. 13 shows a modification of the circuit of FIG. 12 that incorporates CMOS bias amplifier circuitry.

In accordance with the invention, this variation can be reduced by incorporating the CMOS bias amplifier described above into the circuit of FIG. 12, to result in the improved circuit architecture of FIG. 13. The bias amplifier modification is shown at 160, and comprises an auxiliary diode-connected P channel MOSFET P161 that is matched with P channel MOSFETs p162–p164, and N channel MOSFET N161, that is matched with current mirror N channel MOSFETs N162 and 163, as shown. As in the circuit of FIG. 7, the current generator circuit of FIG. 13 can function at very low power supply voltages and is still able to maintain good power supply rejection.

Figure 14:
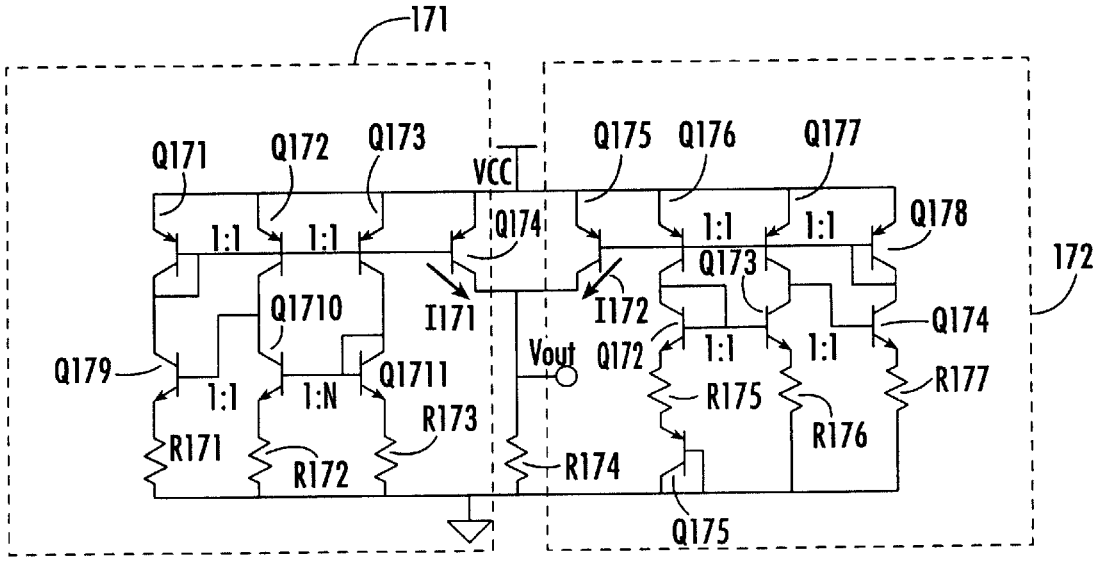
FIG. 14 shows an embodiment of a temperature compensated bipolar transistor-configured bandgap voltage generator.
Figure 15:
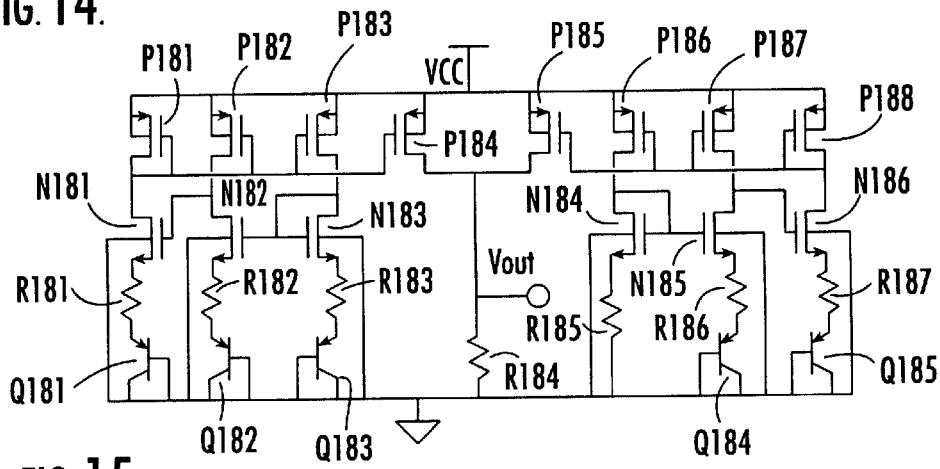
FIG. 15 is an equivalent CMOS-implemented version of the bandgap voltage generator of FIG. 14.

FIG. 14 shows an embodiment of a temperature compensated bipolar transistor-configured bandgap voltage generator circuit using the bias amplifier circuitry of FIG. 5, and is configured to generate an output reference voltage $V_{OUT}$ that is relatively insensitive to changes in both supply voltage and temperature. An equivalent CMOS-implemented version of the bandgap generator circuit of FIG. 14 that will be readily appreciated from the circuit architecture of FIG. 14 is shown in FIG. 15.

The dual compensation effect (for power supply and temperature variations) is achieved by forming two independent current generator circuits, shown in FIG. 14 by broken lines 171 and 172, each of which uses the bias amplifier described above to improve its PSR. The output currents I171 and I172 of these two current generator circuits is summed and passed through an output resistor R174 to produce the reference voltage $V_{OUT}$.

The current generator circuit 171 is configured to produce output current I171 in proportion to the thermal voltage $V_T$ divided by the difference between the values of resistors R173 and R172, as set forth in equation (39).

$$I171 = \frac{V_T * \ln(N)}{(R173 - R172)} \tag{39}$$

The current generator circuit 172 is configured to produce output current I172 in proportion to the base emitter junction voltage Vbe of transistor Q175 divided by the difference between the values of resistors R176 and R175, as set forth in equation (40).

$$I172 = \frac{V_{be}(Q175)}{(R176 - R175)} \tag{40}$$

By proper choice of the values of these resistors, the output voltage $V_{OUT}$ across resistor R174 can be made to have a low temperature coefficient. If the resistors are fabricated using a material that is readily laser trimable, such as NiCr, the circuit of FIG. 14 allows I171, I172, and $V_{OUT}$ to be adjusted during circuit probe operation. The output current I171 produced by current generator 171 can be increased by increasing the value of resistor R172 via laser trimming techniques. For a non-limiting example of a mechanism for trimming bias currents either up or down, attention may be directed to U.S. Pat. No. 5,686,822. Conversely, the output current I171 can be decreased by laser trimming resistor R173 to increase its value. Similarly, the output current I172 produced by current generator 172 can be increased or decreased by trimming either resistor R175 or resistor R176. $V_{OUT}$ can be increased by trimming output resistor R174.

As will be appreciated from the foregoing description, the present invention augments the reduced sensitivity of an auxiliary bias amplifier-incorporating current generator circuit architecture to variations in power supply voltage by means of temperature compensation circuitry that is effective to make the current generator insensitive to variations in both power supply voltage and temperature. The invention also provides a CMOS current generator architecture having an auxiliary CMOS amplifier that is configured and biased to reduce its sensitivity to variations in power supply voltage. The CMOS current generator may also include temperature compensation circuitry, so as to provide an output current that is insensitive to both variations in power supply voltage and temperature. As such, the CMOS configured circuit of the invention may also be used to generate a stable reference voltage.

While we have shown and described various embodiments in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. A current generator comprising:

a current mirror circuit coupled between first and second voltage supply terminals, and including an output current mirror transistor from which an output current is derived;

an electrical parameter control circuit coupled to said current mirror circuit and being operative to equalize electrical parameters in respective legs of said current mirror circuit independent of a variation in supply voltage coupled to said first and second voltage supply terminals; and a temperature compensation circuit coupled to said current mirror circuit, and containing first and second current flow paths producing respective first and second currents having complementary temperature coefficients and being combined to produce said output current that is effectively insensitive to changes in temperature.

2. The current generator according to claim 1, wherein said first current flow path of said temperature compensation circuit includes a first transistor producing said first current that has a positive temperature coefficient, proportional to KT/q (where K is Boltzman's constant, T is temperature (°C.) and q is charge), and wherein said second current flow path of said temperature compensation circuit produces said second current that has a negative temperature coefficient associated with a PN junction of a second transistor, and wherein said first and second currents are summed into a composite current that is mirrored by said output current mirror transistor to produce said output current.

3. The current generator according to claim 2, wherein said first transistor is coupled in a first leg of said current mirror circuit, and said second current flow path includes a first resistor coupled to a control electrode of said second transistor of said second current flow path, and said first current flow path includes a second resistor coupled in circuit with an output current path electrode of said first transistor.

4. The current generator according to claim 3, further including a first auxiliary transistor coupled in current mirror configuration with said current mirror circuit, a second auxiliary transistor coupled in circuit with said first auxiliary transistor and a third resistor coupled in circuit with said second auxiliary transistor in the same manner as said first resistor is coupled with said second transistor, and being operative to divert current from said second leg of said current mirror circuit.

5. The current generator according to claim 4, wherein said first transistor of said second leg of said current mirror circuit has a geometry larger than that of said second transistor.

6. The current generator according to claim 5, wherein said first transistor is comprised of a first plurality of parallel connected transistor devices and said second transistor is comprised of a second plurality of parallel connected transistor devices, such that the difference between said first and second numbers of transistor devices is at least an order of magnitude less than the numbers of said first and second pluralities of transistor devices.

7. The current generator according to claim 5, wherein said first transistor is comprised of a first plurality of parallel connected transistor devices and said second transistor is comprised of a second plurality of parallel connected transistor devices, such that the difference between said first and second numbers of transistor devices is on the order of two orders of magnitude less than the numbers of said first and second pluralities of transistor devices.

8. The current generator according to claim 4, wherein said first auxiliary transistor is effectively matched with transistors of said current mirror circuit, and wherein said second auxiliary transistor is effectively matched with said second transistor of said second leg of said current mirror circuit.

9. The current generator according to claim 4, further including a third auxiliary transistor coupled in current mirror configuration with said current mirror circuit, a fourth auxiliary transistor coupled in circuit with said third auxiliary transistor and said second transistor of said second leg of said current mirror circuit.

10. The current generator according to claim 9, further including a fifth auxiliary transistor coupled in circuit with said first auxiliary transistor and a sixth auxiliary transistor coupled in circuit with said fifth auxiliary transistor and said third auxiliary transistor.

11. The current generator according to claim 1, wherein said current mirror circuit is configured as a CMOS transistor current mirror circuit.

12. The current generator according to claim 1, further including an output resistor coupled in circuit with said output current mirror transistor and being operative to generate an output voltage in proportion to said output current.

13. A temperature compensated current mirror circuit comprising:

a current mirror circuit coupled between first and second voltage supply terminals, and including an output current mirror transistor from which an output current is derived; and a temperature compensation circuit including first and second current flow paths producing respective first and second currents having complementary temperature coefficients and being operative to cause said output current to be effectively insensitive to changes in temperature, said first current flow path including a first transistor producing said first current having a positive temperature coefficient, proportional to KT/q (where K is Boltzman's constant, T is temperature (°C.) and q is charge), said second current flow path producing said second current having a negative temperature coefficient associated with a PN junction of a second transistor, and said first and second currents being summed into a composite current that is mirrored by said output current mirror transistor to produce said output current, and wherein said first transistor is comprised of a first plurality of parallel connected transistor devices and said second transistor is comprised of a second plurality of parallel connected transistor devices, such that the difference between said first and second numbers of transistor devices is at least an order of magnitude less than the numbers of said first and second pluralities of transistor devices.

14. The temperature compensated current mirror circuit according to claim 13, wherein said first transistor is coupled in a first leg of said current mirror circuit, and said second current flow path includes a first resistor coupled to a control electrode of said second transistor of said second current flow path, and said first current flow path includes a second resistor coupled in circuit with an output current path electrode of said first transistor.

15. The temperature compensated current mirror circuit according to claim 13, wherein said first transistor is comprised of a first plurality of parallel connected transistor devices and said second transistor is comprised of a second plurality of parallel connected transistor devices, such that the difference between said first and second numbers of transistor devices is on the order of two orders of magnitude less than the numbers of said first and second pluralities of transistor devices.

16. A CMOS electrical reference generator comprising:

a CMOS current mirror circuit coupled between first and second voltage supply terminals;

an electrical parameter control circuit coupled to said CMOS mirror circuit and being operative to equalize currents flowing through first and second legs of said CMOS current mirror circuit irrespective of a variation in supply voltage coupled to said first and second voltage supply terminals;

an output current CMOS transistor coupled in current mirror configuration with said CMOS current mirror circuit and providing said electrical reference as a prescribed output current that is effectively insensitive to said variation in supply voltage; and a temperature compensation circuit coupled to said CMOS current mirror circuit, and containing first and second current flow paths producing respective first and second currents having complementary temperature coefficients, said first and second currents being combined to produce said prescribed output current that is effectively insensitive to changes in temperature.

17. The CMOS electrical reference generator according to claim 16, further including an output resistor coupled to said output current mirror CMOS transistor, and being operative to provide said electrical reference as an output voltage that is proportional to said prescribed output current and effectively insensitive to said variation in supply voltage.

18. A temperature compensated voltage generator comprising:

first and second independently operating complementary temperature coefficient-based current generator circuits which are operative to generate first and second output currents which are summed and coupled to an output resistor to produce a reference voltage;

said first current generator circuit being configured to produce said first output current proportional to temperature; and said second current generator circuit being configured to produce a second output current inversely proportional to temperature.

19. The temperature compensated voltage generator according to claim 18, wherein said first current generator circuit comprises a first transistor circuit having a positive temperature coefficient, proportional to KT/q (where K is Boltzman's constant, T is temperature (°C.) and q is charge), and containing a first selectively variable resistance, and wherein said second current generator circuit comprises a second transistor circuit having a negative temperature coefficient associated with a PN junction of a second transistor circuit and having a second selectively variable resistance.

* * * * *